United States Patent [19]

Hubbard

[11] 4,160,343

[45] Jul. 10, 1979

[54] WINDOW SHUTTER AND MOUNTING THEREFOR

[76] Inventor: Junius P. Hubbard, P.O. Box 555, Aransas Pass, Tex. 78336

[21] Appl. No.: 838,217

[22] Filed: Sep. 30, 1977

[51] Int. Cl.[2] ..... E06B 7/086

[52] U.S. Cl. ..... 49/90

[58] Field of Search ..... 49/90, 91, 92, 371; 160/236, 232

[56] References Cited

U.S. PATENT DOCUMENTS

| | | | |
|---|---|---|---|
| 4,038,781 | 8/1977 | Graham | 49/90 X |
| 4,057,936 | 11/1978 | Wyatt, Jr. et al. | 49/91 X |

FOREIGN PATENT DOCUMENTS

| | | | |
|---|---|---|---|
| 206649 | 2/1940 | Switzerland | 49/90 |

*Primary Examiner*—Kenneth Downey
*Attorney, Agent, or Firm*—G. Turner Moller

[57] ABSTRACT

There is disclosed a heat insulating window shutter arrangement comprising a plurality of slats of organic polymeric foam material. The slats comprise configured side edges to mate substantially flush with complimentarily configured slats. The shutter mounting arrangement includes a convex deformable element in continuous engagement with an end surface of each slat.

16 Claims, 6 Drawing Figures

WINDOW SHUTTER AND MOUNTING THEREFOR

This invention relates to a window shutter of the type comprising a plurality of generally parallel slats which are movable between a first position substantially obscuring a window or window opening and a plurality of second positions generally transverse to the first position to at least partially expose the window to allow viewing therethrough. More particularly, this invention relates to a window shutter arrangement which acts to substantially minimize thermal loss through the window when the shutters are in the first position obscuring the window.

The provision of window shutter arrangements comprising a plurality of rectangular generally parallel slats which are movable between a first position obscuring the window and a second position for partially exposing the window is old and well known in the prior art. Exemplary configurations are illustrated in U.S. Pat. No. 2,828,816 and Italy Pat. No. 556,800.

Applicant has designed an energy efficient building incorporating the window shutter arrangement of this invention. Based on a 1,000 square foot residence located in Albuquerque, N. Mex. (requiring 4,300° F. days of heating), the total thermal loss during heating days is reduced from $37.5\times10^6$ BTU/year to $24.9\times10^6$ BTU/-year by the addition of the window shutter arrangement of this invention. Accordingly, the thermal loss during heating days is reduced by about one-third.

It is known in the prior art to provide window shutter arrangements of rectangular generally parallel slats of organic polymeric material as shown in U.S. Pat. Nos. 2,748,048; 2,828,816; 3,031,013 and Germany Pat. No. 2,138,812. It is apparent, however, that none of these patents involve the problem of reducing or minimizing the thermal loss or gain to a building through convection, conduction or radiation through the use of a foam material.

The present invention overcomes the foregoing and other disadvantages of the prior art by providing a novel and improved window shutter arrangement and mounting system therefor. Specifically, the window shutter arrangement of this invention comprises a plurality of opaque generally parallel rectangular slats of organic polymeric foam material exhibiting a thermal conductivity of less than about 0.40 BTU-inch/hour-square foot-°F. The slats provide longitudinally extending edges configured to mate with a complimentarily configured edge of an adjacent slat in order to minimize air circulation and therefore convection losses across the slats when in a window obscuring position. The slats are preferably white or other light color in order to substantially reduce radiant heating of the slats in the window obscuring position. Because of these factors, thermal loss across the window during heating days and thermal gain through the window during cooling days is considerably reduced.

This invention also comprises a simple, inexpensive and convenient technique for holding the slats in the position obscuring the window, and in a plurality of positions tranverse to the first position for at least partially uncovering the window. The slat mounting mechanism comprises a rod and socket connection operating between the slat and a resilient deformable member mounted to engage an end slat surface. Frictional engagement between the deformable member, as well as the force necessary to deform the member, acts to retain each slat in any position to which it is moved.

It is an object of this invention to provide an improved thermal insulating window shutter arrangement comprising a plurality of slats of organic polymeric foam exhibiting a low measure of thermal conductivity.

Another object of the invention is to provide a window shutter arrangement having an improved means for holding a slat in one of a multiplicity of positions.

Other objects and a fuller understanding of the invention may be had by referring to the accompanying description and the appended claims, taken in conjunction with the accompanying drawing.

Figure 1:
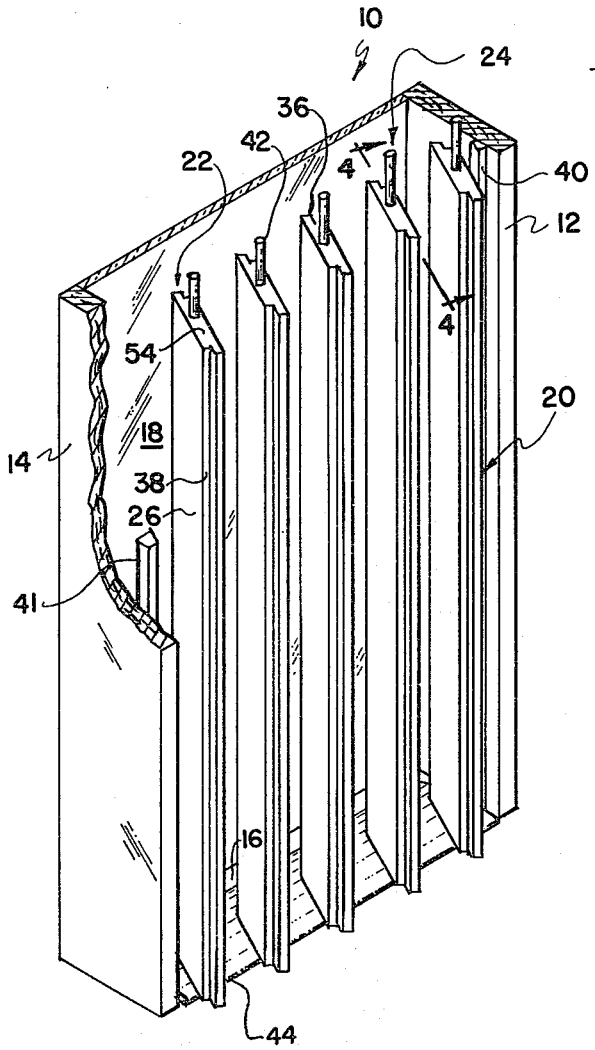
FIG. 1 is a broken isometric view of a window shutter arrangement of this invention illustrating the slats thereof in a positon transverse to the plane of its associated window.

Referring to FIG. 1, there is illustrated typical window construction 10 comprising a pair of vertical risers 12, 14, a sill 16 and a glass pane 18 associated with a window shutter arrangement 20 of this invention.

Figure 3:
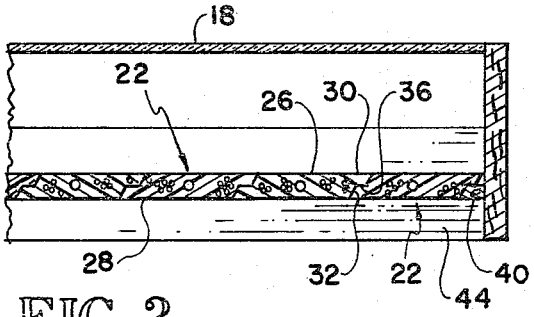
FIG. 3 is an enlarged partially transverse cross-sectional view of the window shutter arrangement of FIG. 1 illustrating the same in the closed or window obscuring position.

The window shutter arrangement 20 comprises a plurality of rectangular slats 22 pivotally mounted by a mechanism 24 for movement between a first position, illustrated in FIG. 3, where the slats 22 substantially obscure the glass pane 18 and a second position, illustrated in FIG. 1, where the individual slats 22 are disposed transversely to the plane of the glass pane 18 for at least partially uncovering the pane 18.

The slats 22 are preferably substantially identical and are of generally rectangular configuration in plan having a planar front face or section 26 facing the glass pane 18 in the window obscuring position and a planar rear face or section 28 facing away from the pane 18 in the window obscuring position of FIG. 3. The longitudinal side edges of the slat 22 comprise a tonque 30, 32 offset on opposite sides of a central plane 34 parallel to the faces 26, 28. The longitudinal edges of the slat 22 accordingly provide a notch or recess 36, 38 positioned to receive the tongue 30, 32 of an adjacent slat as is apparent in FIG. 3.

Figure 2:
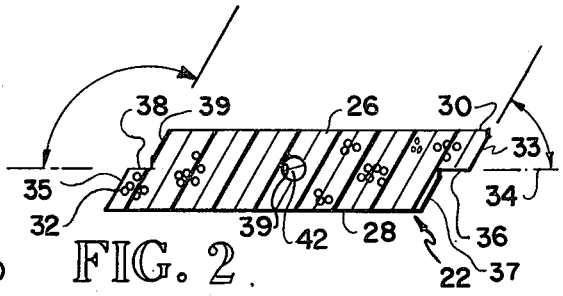
FIG. 2 is an enlarged transverse cross-sectional view of an individual slat comprising part of the arrangement of this invention.

As is apparent from FIGS. 2 and 3, the tongues 30, 32 are preferably not rectilinear but desirably provide inclined side faces 33, 35 in order to allow relative pivotal movement between adjacent slats 22 without binding. Similarly, the recesses 36, 38 are preferably not rectilinear but desirably include inclined side faces 37, 39. The side faces 33, 35 thus define generally parallel planes at an acute angle relative to the plane 34 while the side faces 37, 39 define parallel planes at an obtuse angle relative to the plane 34. Accordingly, adjacent slats 22 are capable of pivotal movement between a generally coplanar position and a plurality of generally parallel positions without binding.

From FIG. 2, it is seen that the slat 22 is symmetrical about an axis extending through a passage 39 traversing the longitudinal dimension of the slat 22. In the window obscuring position of FIG. 3, the end slats 22 abut, in the notches 36, 38 thereof, a stop 40, 41 on the risers 12, 14. The stops 40, 41 not only establish a limit of movement of the slats 22 but also act to seal the margins of the window shutter arrangement 20. It will also be apparent that there is minimal air passage between adjacent slats 22 thereby substantially reducing thermal losses due to convection.

The slat 22 is made of an organic polymeric foam material exhibiting a low thermal conductivity value. The slats 22 exhibit sufficient mechanical strength to accommodate normal useage and desirably do not include separate longitudinally extending reinforcements except to the extent afforded by a longitudinally extending rod 42 comprising part of the mounting mechanism 24 as will be more fully explained hereinafter. The organic polymeric foam selected for the slats 22 is desirably susceptible to large scale, rapid casting or extrusion during manufacturing.

It is desirable that the thermal conductivity value of the material of the slats 22 be less than about 0.40 BTU-inch/hr.-square foot-°F. Such a value is not difficult to obtain with conventional polymeric foams. Preferably, the thermal conductivity value is as low as reasonably possible commensurate with mechanical strength, abrasion or denting resistence, cost of materials and time of manufacture.

With these criteria in mind, it will be apparent that a substantial number of conceivable materials exist for the slats 22. It is preferred, however, that the slats 22 be constructed from a foamable polystyrene material of the same general type presently employed in the molding of ice buckets, beverage can holders and the like. Such polystyrene foams typically exhibit a coefficient of thermal conductivity on the order of about 0.24 BTU-inch/hr-square foot-°F., have a surprising mechanical strength and are susceptible of rapid and inexpensive manufacture. Although the denting or abrasion resistance of such materials is not as great as may be desired, this may substantially be overcome by applying a suitable coating to the exterior of the slat 22. In order to provide a significant thermal insulating feature, the slats 22 are desirably at least about ¼ inch in thickness and preferably are at least about ½ inch in thickness. Most desirably the slats 22 are on the order of about 1½ inches in thickness. So constructed, it is evident that conduction losses through the plurality of slats 22 in the window obscuring position of FIG. 3 is quite low.

Because the slats 22 are opaque and are preferably white or of light color, thermal transfer across a closed bank of the slats 22 due to radiation is substantially reduced. In the event a coating is applied to the slats 22, it may be selected from a group of shiney or metalized coatings thereby further decreasing thermal transfer due to radiation.

Figure 4:
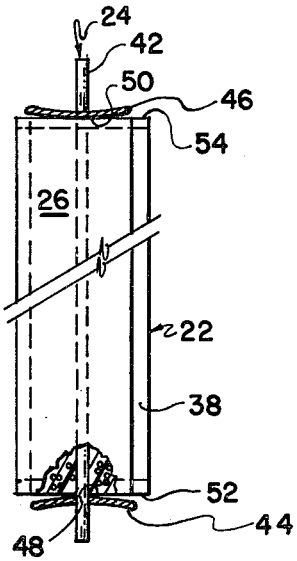
FIG. 4 is an enlarged broken cross-sectional view of the window shutter of FIG. 1 taken substantially along line 4—4 thereof as viewed in the direction indicated by the arrows.

Referring to FIG. 4, there is illustrated one technique for mounting the slats 22 for movement between the positions of FIGS. 1 and 3. The slat 22 is illustrated as comprising a rod 42 cast in place inside the slat 22 during manufacture. The rod 42 extends, at both ends thereof, through an opening in an arcuate sheet-like member 44, 46. The arcuate deformable members 44, 46 are preferably convex toward the slat 22 in the window obscuring position thereof and provide a surface section 48, 50, adjacent the rod receiving opening, respectively in constant engagement with a concave lower and upper end surface 52, 54 of the slat 22.

The arcuate members 44, 46 are preferably resilient and deformable and are curved to substantially match the concave end surfaces 52, 54 to retain the slats 22 in the window obscuring position without deforming the members 44, 46. When moving the slats 22 toward the open position, the concave end surfaces 54, 56 deform the members 44, 46 slightly and thereby frictionally retain the slats 22 in any desired partially open position. The slats 44 are of an organic polymeric material, such as polyethylene, polypropylene and the like, or may be of sheet metal, for example an iron alloy or aluminum. The engagement between the arcuate members 44, 46 and the slat end surfaces 52, 54 in the slat open position is preferably quite light to avoid crushing of the polymeric foam material from which the slat 22 is made. In the window obscuring position of FIG. 3, the members 44, 46 are preferably not deformed so that the slats 22 are held in place by the complementary shapes of the members 44, 46 and the slat end surfaces 52, 54.

Figure 6:
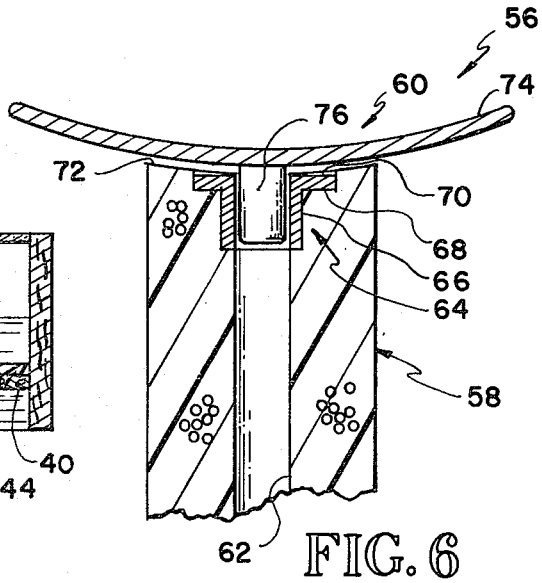
FIG. 6 is an enlarged broken longitudinal cross-sectional view of a window shutter arrangement comprising another embodiment of this invention.
Figure 5:
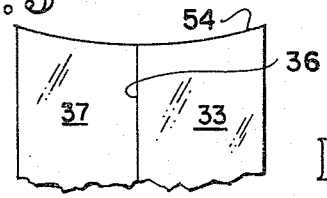
FIG. 5 is a side view of one end of an individual slat.

Referring to FIG. 6, there is illustrated another embodiment 56 of this invention incorporating a slat 58 and a mounting mechanism 60. The slat 58 is of generally the same construction as the slat 22 but provides a passage 62 extending in the longitudinal direction of the slat 58 having a wear resistant grommet or eye 64 in the terminal ends of the passage 62. The grommet 64 comprises a tubular section 66 extending axially of the passage 62 and a flange 68 extending annularly about the tubular section 66. The flange 68 comprises an outer surface 70 which may be substantially flush with an end surface 72 of the slat 58 or spaced slightly outwardly therefrom toward an arcuate deformable member 74 of the mounting mechanism 60.

The mounting mechanism 60 includes the arcuate member 74 and a rod of suitable description extending into or through the grommet 64. As an alternate means of mounting, the arcuate member 74 may incorporate a cylindrical projection 76 integral therewith extending into the tubular section 66 of the grommet 64.

Although the invention has been described in its preferred forms with a certain degree of particularity, it is understood that the present disclosure of the preferred form has been made only by way of example and that numerous changes in the details of construction and the combination and arrangement of parts may be resorted to without departing from the spirit and scope of the invention as hereinafter claimed.

I claim:

1. A shutter arrangement for selectively obscuring and uncovering a window, comprising a plurality of elongate slats, at least one end surface of each slat is concave toward the slat; and means mounting the slats for movement between a first position for obscuring the window and a multiplicity of second positions transverse to the first position for at least partially uncovering the window, the mounting means comprising means individually mounting each slat for movement about an axis extending longitudinally of the slats; and means for individually holding each slat in any one of the second positions including a resilient deformable member mounted in non-rotating relation to the window and of convex configuration complementary to the concave end surface of the slats, the resilient member being deformed only when the slats are in any one of the second positions.

2. The arrangement of claim 1 wherein the slat comprises longitudinally extending front and rear surfaces and transversely extending end surfaces, the deformable member being positioned for engagement with one of the end surfaces.

3. The arrangement of claim 2 wherein the deformable member extends across a plurality of the slats for simultaneous engagement therewith.

4. The arrangement of claim 2 wherein the deformable member is in continuous engagement with the slat end surface throughout a range of movement away from the first position toward the second position.

5. The arrangement of claim 2 wherein the pivotal mounting means comprises a rod and socket connection between the slat and the deformable member.

6. The arrangement of claim 5 wherein the slat comprises a passage extending into one end thereof and the rod and socket connection comprises a grommet in the terminal end of the passage.

7. The arrangement of claim 1 wherein the one slat end surface and the deformable members are of generally smooth curvature of approximately the same radius of curvature.

8. The arrangement of claim 1 wherein each of the slats comprise a generally rectangular opaque member consisting essentially of organic polymeric foam, exhibiting a thermoconductivity of less than about 0.40 BTU-in/hr-sq ft-°F., the slats being of predetermined length and width and having a significant thermo-insulating thickness.

9. The arrangement of claim 8 wherein each slat comprises a pair of longitudinally extending edges, and a portion of reduced thickness on each longitudinal edge for mating with a complementarily configured edge of the next adjacent slat, the axes of adjacent slats being closer together than the width of the slats.

10. The arrangement of claim 9 wherein the slats are parallel to a common plane in the first position.

11. The arrangement of claim 10 wherein one longitudinal edge of each slat comprises a first tongue offset relative to a plane extending through the center of the slat providing a first notch for receiving a second tongue of an adjacent slat.

12. The arrangement of claim 11 wherein the other longitudinal edge of each slat comprises the second tongue offset relative to the plane extending through the center of the slat providing a second notch for receiving the first tongue of an adjacent slat.

13. The arrangement of claim 12 wherein the first and second tongues are offset on opposite sides of the plane extending through the center of the slat.

14. The arrangement of claim 13 wherein the exposed longitudinally extending surfaces of the slats in the first position define generally parallel planes.

15. The arrangement of claim 13 wherein the side surfaces of each tongue defines, with the plane, an acute angle.

16. The arrangement of claim 15 wherein the side sufaces of each recess defines, with the plane, an obtuse angle.

* * * * *